United States Patent [19]

Gibson

[11] 4,389,991

[45] Jun. 28, 1983

[54] ROTATION SENSITIVE PRESSURE REGULATOR

[75] Inventor: Dennis H. Gibson, Edelstein, Ill.

[73] Assignee: Caterpillar Tractor Co., Peoria, Ill.

[21] Appl. No.: 261,097

[22] PCT Filed: Sep. 11, 1980

[86] PCT No.: PCT/US80/01168

§ 371 Date: Sep. 11, 1980

§ 102(e) Date: Sep. 11, 1980

[87] PCT Pub. No.: WO82/01036

PCT Pub. Date: Apr. 1, 1982

[51] Int. Cl.[3] ..... F02D 7/00

[52] U.S. Cl. ..... 123/383; 123/341

[58] Field of Search ..... 123/382, 383, 385–388, 123/340, 341

[56] References Cited

U.S. PATENT DOCUMENTS

| | | | |
|---|---|---|---|
| 2,566,188 | 8/1951 | Gleitz | 123/387 |
| 2,868,184 | 1/1959 | Moulton | 123/383 |
| 2,910,969 | 11/1959 | Reggio | 123/386 |
| 3,667,439 | 6/1972 | Muir | 123/387 |
| 3,777,730 | 12/1973 | Gates et al. | 123/385 |
| 3,795,233 | 3/1974 | Crews et al. | 123/383 |
| 3,818,883 | 6/1974 | Glassey | 123/382 |
| 4,050,434 | 9/1977 | Zbikowski et al. | 123/385 |
| 4,068,642 | 1/1978 | Little, Jr. | 123/382 |
| 4,084,601 | 4/1978 | Rowen | 137/49 |
| 4,136,656 | 1/1979 | Sokolov et al. | 123/383 |
| 4,149,507 | 4/1979 | Little, Jr. et al. | 123/383 |

FOREIGN PATENT DOCUMENTS

| | | |
|---|---|---|
| 1117008 | 2/1956 | France . |
| 2016482 | 5/1970 | France . |

*Primary Examiner*—Charles J. Myhre
*Assistant Examiner*—Magdalen Moy
*Attorney, Agent, or Firm*—Phillips, Moore, Lempio & Finley

[57] ABSTRACT

This disclosure relates generally to fuel delivery systems for combustion ignition engines and more particularly to devices for limiting exhaust smoke and/or the rise in engine torque. When a compression ignition engine is operating at full speed and a load is applied to the engine, the engine speed decreases until a lug condition results. As the engine speed decreases, a greater volume of fuel is delivered to the combustion chambers resulting in an inherent increase in the output torque of the engine and in the production of smoke. The rotation sensitive pressure regulator (7) described herein solves these problems by using a movable spool valve (21*a*). Stability of the regulator (7) is also achieved by using a spring (40) that adjusts the static force applied to the spool valve (21*a*) and a nondeformable actuator member (19).

7 Claims, 2 Drawing Figures

ROTATION SENSITIVE PRESSURE REGULATOR

DESCRIPTION

1. Technical Field

This invention relates generally to fuel delivery systems for combustion ignition engines and more particularly to apparatus for limiting exhaust smoke and/or the rise in engine torque.

2. Background Art

When a compression ignition engine is operating at full speed and load is applied to the engine, the engine speed decreases until a lug condition results. As the engine speed decreases, the delivery of the fuel pump increases and a greater volume of fuel is delivered to the combustion chambers. The increased fuel delivery results in an inherent increase in the output torque of the engine. In some engines, particularly turbocharged engines, the natural torque rise under such conditions is also detrimental to effective control of exhaust emissions inasmuch as excessive smoke is produced from the engine.

It has been found that excessive smoke production and damaging increases in torque can be prevented by decreasing the amount of fuel delivered to the combustion chambers as the engine speed decreases from its rated to its peak torque speed.

The task of decreasing the amount of fuel delivered as engine speed decreases typically cannot be performed by a conventional governor alone. A governor increases the delivery of fuel as engine speed decreases in order to maintain engine speed constant. This is the primary function of a governor. On some engines a fuel air ratio controller and a speed sensitive regulator are used in combination with a governor to override the governor. Such fuel air ratio controllers are disclosed in U.S. Pat. No. 3,313,283 entitled "Fuel Ratio Control Override" issued on Apr. 11, 1967 to R. H. Miller; U.S. Pat. No. 4,068,642 entitled "Fuel Ratio Control with Manually Operated Air Override" issued on Jan. 17, 1978 to J. P. Little, Jr.; and U.S. Pat. No. 4,149,507 entitled "Fuel-Air Ratio Control with Torque-Limiting Spring for Supercharged Engines" issued on Apr. 17, 1979 to J. P. Little, Jr. et al. One device for regulating a fuel air ratio controller is disclosed in U.S. Pat. No. 4,136,658, entitled "Speed Sensitive Pressure Regulator System" issued on Jan. 30, 1979 to Gates and assigned to the assignee of the present application. Other work in this field of technology includes U.S. Pat. No. 3,695,245 entitled "Fuel Supply System for Internal Combustion Engines" by Ishida issued on Oct. 3, 1972; U.S. Pat. No. 3,916,862 entitled "Torque Rise Limiting Device" by Clouse et al issued on Nov. 4, 1975; U.S. Pat. No. 3,532,082 entitled "Minimum-Maximum Governor With Midrange Regulation" by Clouse et al issued on Oct. 6, 1970; and U.S. Pat. No. 3,911,855 entitled "Torque Rise Limiting Governor" by Hammond issued on Oct. 14, 1975.

Previous devices for controlling torque rise have not always provided the desired service life. These prior controllers, for example, employ springs that can change in elasticity and/or diaphragms that can rupture due to wear.

Further, there are only a limited number of engines that actually require such a controller. Thus, there is a continuing search for a device which will satisfy these tasks and can be easily installed as an accessory to a conventional governor.

The present invention is directed to overcoming one or more of the problems as set forth above.

DISCLOSURE OF THE INVENTION

In one aspect of the present invention, a rotation sensitive pressure regulator comprises an inlet, an outlet, a reciprocal valve spool, a flyweight assembly for moving the valve spool in a first direction in response to rotation thereof to communicate the inlet with the outlet, and means for urging the valve spool in an opposite, second direction in response to fluid pressure in the outlet.

In a second and more specific aspect of this invention, such means includes a pressure chamber exposed to an end of the valve spool and to the outlet and may further include an adjustable spring. In addition, the outlet is preferably adapted to be vented in response to a preselected movement of the valve spool in the second direction.

In a third aspect of the invention, the pressure regulator is combined in an apparatus for preventing excessive torque and/or smoke in a combustion engine. In this combination, the regulator's inlet is connected to the engine's intake manifold, a fuel/air ratio controller is connected to the regulator's outlet, and a fuel rack is connected to the controller to be activated thereby.

Reliable and repeatable performance is attained by utilizing a nondeformable actuator member which eliminates the necessity for a diaphragm and an actuating spring. The stability of the regulator is provided through the use of a spring that can adjust the static force on the spool valve.

The problem of providing an apparatus that will utilize existing equipment is met by providing a regulator that requires just an engine speed input shaft and a source of fluid pressure and can be conveniently attached at many locations on the engine.

Other aspects, objects and advantages of this invention can be obtained from a study of the drawings, the disclosure and the appended claims.

BEST MODE FOR CARRYING OUT THE INVENTION

Figure 1:
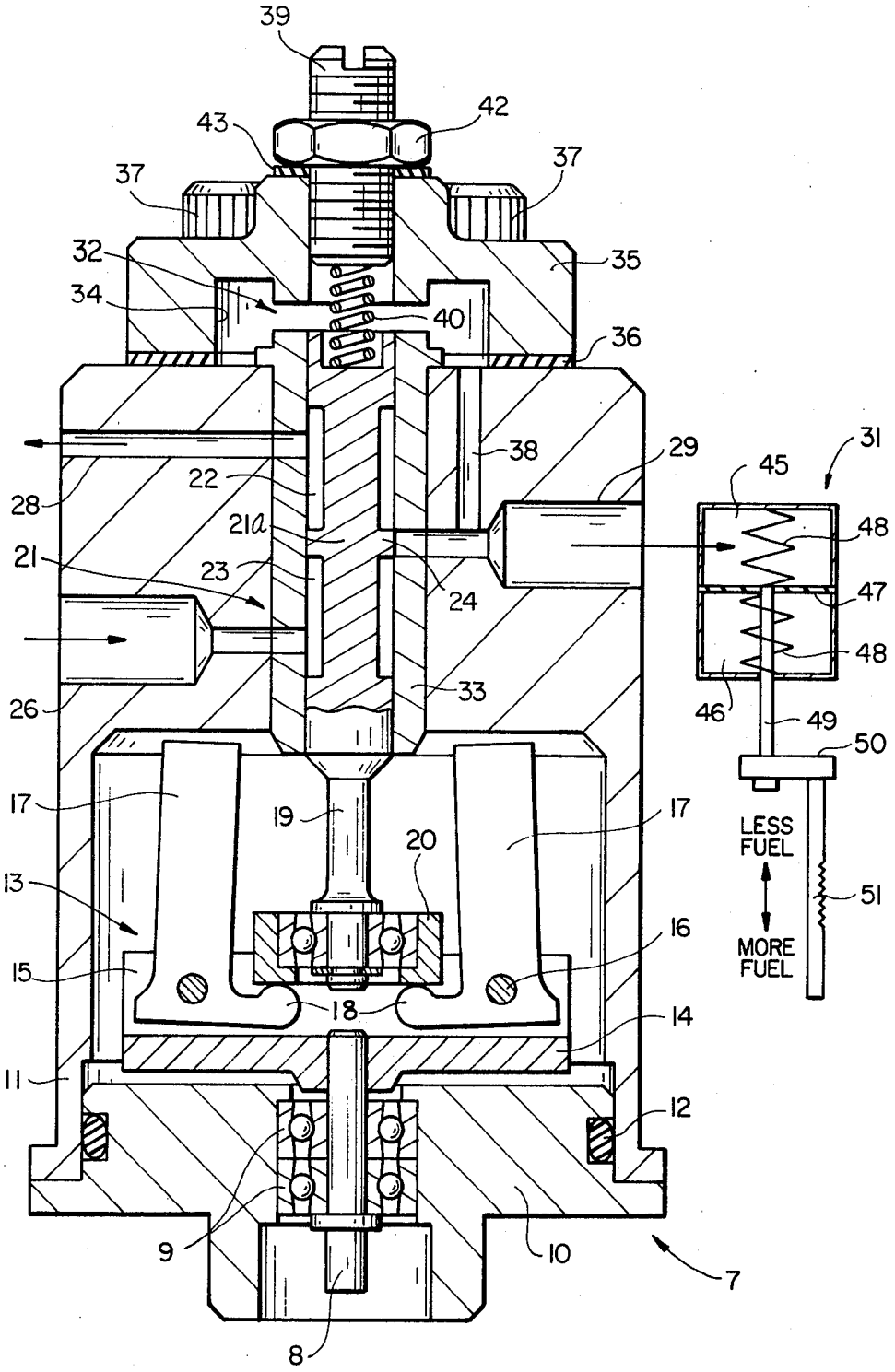
FIG. 1 is a diagrammatic side elevational view in cross section of the present invention.

FIG. 1 illustrates a rotation sensitive pressure regulator 7 that is used on a compression ignition engine (not shown). The regulator includes a speed input shaft 8 that is driven by the engine at a speed proportional to the crankshaft speed. The input shaft is mounted for rotation within two duplex bearings 9 that are rigidly mounted in a base 10. The base attaches the regulator 7 to the engine (not shown) and seals the bottom of the regulator 7 from contamination by dirt and oil. The regulator 7 further includes a body or housing 11 which houses the apparatus. The base 10 and the body 11 are sealed by an O-ring 12.

The speed input shaft 8 rotates a fly-weight assembly 13 that includes a disc shaped carrier 14 on which is mounted a plurality of clevices 15. On each clevice is a pin 16 that acts as a pivot for a fly-weight 17. The fly-weights are located between the clevices and pivot about the pins 16. When the shaft 8 rotates, the carrier 14 rotates at the same speed and the fly-weights pivot outwardly away from the axis of rotation due to centrifugal force.

Each fly-weight 17 has a toe 18 that engages the outer race or ring of a bearing 20. The inner race of the bearing is rigidly attached to a nondeformable actuator member 19 that is an integral part of valve means 21 for regulating the outlet fluid pressure of the regulator 7. More precisely, the member 19 is a stem located on the lower end of a spool valve 21*a* and serves as a rigid coupling directly engaged by both the fly-weight assembly 13 and the spool valve for moving the spool valve in an upward direction in response to rotation of the fly-weight assembly. The bearing 20 permits the fly-weights to rotate relative to the spool valve during operation. The spool valve has upper and lower relieved portions 22, 23, respectively, that form a control land 24. Throughout the range of motion of the spool valve 21*a*, the upper relieved portion 22 communicates with a vent conduit 28 in the body 11 and the lower relieved portion 23 communicates with a supply conduit or inlet 26. The supply conduit is connected to a source of fluid pressure (not shown). When used on a supercharged or turbocharged engine, the supply conduit 26 is connected to the intake manifold so that the regulator is supplied with pressurized air corresponding to the manifold pressure.

As illustrated in FIG. 1, the control land 24 covers a controlled air conduit or outlet 29. During operation, regulated air at a predetermined pressure is provided through this conduit 29 to a fuel air ratio controller 31 as described below. The spool valve 21*a* slides up and down within a bushing 33 that is rigidly mounted within the body 11 of the regulator 7. The conduits 26, 28 and 29 communicate with the spool valve through the bushing. The clearance between the spool valve and the bushing is approximately $3.30\times10^{-6}$m (130 millionths of an inch) so that air may be controlled by this spool valve. The spool valve 21*a* and the bushing 33 can be fabricated from either stainless steel or porcelain. Porcelain is preferred if high temperature moisture laden air is to be encountered from the intake manifold.

Referring now to the upper portion of FIG. 1, the regulator 7 is provided with means 32 for urging the spool valve 21*a* in a downward direction in opposition to the fly-weight assembly 13 in response to fluid pressure in the outlet 29. The urging means includes a cavity or chamber 34 formed around the top of the bushing 33 by a cover 35 and a gasket 36 secured to the regulator housing 11 by a plurality of bolts 37 and which seal the fluid pressure within the regulator. The cavity is connected to the controlled air conduit 29 by a passage 38.

The urging means 32 further includes a compression spring 40 which urges the spool valve 21*a* in a downward direction and places a static force on the spool valve that opposes the upward force generated by the rotation of the fly-weights 17. An adjustment screw 39 is threadably received in the cover 35 to adjust the compression of the spring which provides a way to vary the effect of the fly-weights and to move the operating curve of the regulator as described below in connection with FIG. 2. When the adjustment screw 39 is properly positioned, the screw is locked in place with a jam nut 42 that engages the adjustment screw 39 and the cover 35. A rubber seal washer 43 is used to prevent the escape of fluid pressure from around the screw.

The regulator 7 controls the pressure in the controlled air conduit 29 by moving the control land 24 on the spool valve 21*a* with respect to the conduit 29. The position of the control land is controlled by a plurality of forces. The downward force on the spool valve includes a force due to the fluid pressure in the cavity 34 under the cover 35. The pressure in this cavity 34 is equal to the pressure in the controlled air conduit 29 and is communicated to the cavity via the passage 38. In addition, there is a downward force acting on the spool valve due to the static force of the spring 40. The upward force on the spool valve includes the force due to the rotation of the fly-weights 17. This force is equal to a constant K times the square of the speed of the shaft 8 so that the upward force is proportional to the square of the engine speed. The constant K includes the number and mass of the fly-weights, the distance between the center of mass of the fly-weights and the pin 16 and the distance between the toe 18 and the pin 16. The cavity around the fly-weights is vented to the atmosphere so that no fluid pressure acts on the bottom of the spool valve.

The pressure in the controlled air conduit 29 is directed to the fuel air ratio controller 31. The controller includes an upper chamber 45 and a lower chamber 46 separated by a diaphragm 47. The diaphragm is spring loaded with a spring 48 that eliminates preloading the diaphragm. The pressure from the regulator 7 is directed into the upper chamber 45 and the lower chamber 46 is constantly at atmospheric pressure. The bottom of the diaphragm 47 is connected to a bolt 49 that engages a fuel rack collar 50 that positions the fuel rack 51. The purpose of the fuel air ratio controller 31 is to resist the movement of the fuel rack 51 during acceleration and to coordinate movement of the fuel rack 51 with the amount of air available in the intake manifold (not shown). The construction and operation of the fuel air ratio controller is described in the U.S. patents to Miller and Little cited above.

INDUSTRIAL APPLICABILITY

Referring to FIG. 1, the regulator 7 controls the fluid pressure in the controlled air conduit 29 as a function of the rotation of the speed input shaft 8. The speed input shaft is operatively connected to the crankshaft of an engine (not shown) so that the shaft 8 turns at an integral multiple of the speed of the engine. The regulator is connected to a source of fluid pressure such as the intake manifold of a turbocharged engine via the supply conduit 26. The regulator is also vented to the atmosphere through the vent conduit 28.

In operation, the engine turns the speed input shaft 8 at a multiple of the crankshaft speed. If the input shaft 8 increases in speed, the flyweights 17 tend to move outward away from the axis of rotation and thus the toes 18 tend to move the spool valve 21*a* in an upward direction via the actuator member 19. This upward motion tends to connect the fluid pressure in conduit 26 to the controlled air conduit 29 via the lower relieved portion 23 of the spool valve. When the pressure in conduit 29 increases, the pressure in the cavity 34 under the cover 35 increases via passage 38 and tends to force the top of the spool valve in a downward direction against the upward force of the fly-weights. The pressure in conduit 29 is increased until the control land 24 again covers the controlled air conduit 29. A balanced condition results with a predetermined pressure in conduit 29 and with the fly-weight force exactly opposing the spring and output pressure forces.

When the speed of the shaft 8 decreases, the fly-weights 17 tend to move toward the axis of rotation which causes the spool valve 21*a* to move in a downward direction. In addition, the elevated pressure in conduit 29 also acts through passage 38 to force the spool valve in a downward direction. When the spool valve moves downward, the control land 24 vents conduit 29 to the atmosphere via the upper relieved portion 22 of the spool valve and the vent conduit 28. This venting lowers the force on the top of the spool valve and tends to permit the spool valve to move upward. The pressure in conduit 29 is thereby decreased until the control land 24 again covers the controlled air conduit and the opposing forces are balanced.

The regulator 7 through the predetermined pressure in conduit 29 controls the pressure in the upper chamber 45 of the fuel air ratio controller 31. This controller, in turn, controls the position of the fuel rack 51 which regulates the amount of fuel delivery per pump stroke to the cylinders of the engine (not shown). When the pressure in the upper chamber 45 of the controller 31 increases, the bolt 49 permits a larger amount of fuel delivery to the cylinders. The opposite occurs when the pressure in the upper chamber is decreased.

When the fuel rack 51 is positioned for maximum horsepower at rated speed and the engine is then placed under load so that it begins to lug, the fuel pump (not shown) automatically increases the delivery of fuel to the cylinder. This increase in fuel delivery is a function of the change of efficiency of the fuel pump as the engine speed decreases. As described in detail above, when the engine lugs down, the speed input shaft 8 turns at a slower speed. This slower speed decreases the flyweight force and along with the pressure in the passage 38 causes the spool valve to move downward. This vents a portion of the air pressure in the upper chamber 45 out to the atmosphere through the vent conduit 28. The diaphragm 47 in turn moves the rack 51 to reduce the amount of fuel delivery.

Figure 2:
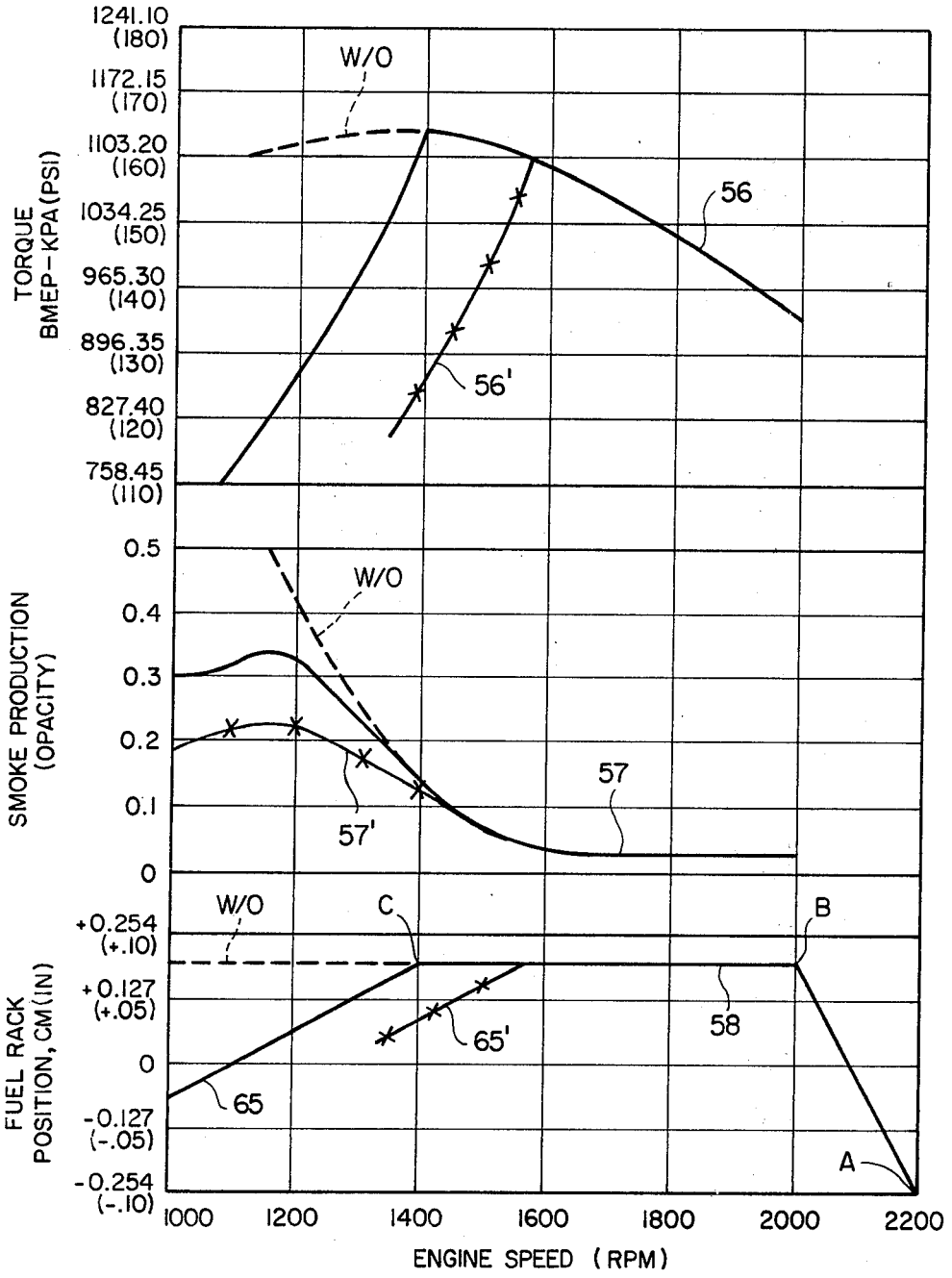
FIG. 2 is a graphic illustration of the torque curves, the generation of smoke and the fuel rack position of an engine that is operated both with and without the embodiment of FIG. 1.

FIG. 2 illustrates the performance curves of an engine that utilizes a rotation sensitive pressure regulator 7 according to the present invention. Graph 56 is the curve of torque (brake mean effective pressure in kPa or psi) vs. engine speed (rpm). Graph 57 illustrates the production of smoke vs. engine speed, and graph 58 illustrates the position of the fuel rack with respect to engine speed. In graph 58 zero indicates the center of the travel of the rack and the graph has an abscissa of plus or minus (0.254 cm) (0.10 inches) either side of center.

Referring to graph 58, FIG. 2, Point A indicates the high idle position where at 2200 rpm there is no load on the engine. Point B is the balance point where maximum horsepower is developed at the rated speed of the engine.

If the engine is started at high idle with no load (Point A) and then is increasingly loaded, the fuel rack moves from Point A to Point B as the engine speed decreases. Once Point B is reached, the rack position is fixed against a mechanical stop (not shown) and the engine begins to lug. The horizontal portion of graph 58 is termed "the fixed rack lug curve." As the engine is loaded down from 2000 rpm (Point B) the torque developed on the engine rises as indicated by graph 56. In addition, the production of smoke increases as illustrated by graph 57.

The broken line portions of the performance curves below 1400 rpm illustrate the operation of the engine if the speed sensitive pressure regulator 7 and the fuel air ratio controller 31 are not used. As shown below 1400 rpm the torque developed by the engine peaks and then falls off (graph 56), the production of smoke increases dramatically (graph 57), and the position of the fuel rack remains fixed (graph 58).

On an engine equipped with a rotation sensitive pressure regulator 7 and a fuel air ratio controller 31 as described above, the production of smoke and the elevation of torque is substantially changed when the engine speed decreases below 1400 rpm. On graph 58 Point C illustrates where the regulator begins to take effect. At that point the fuel rack is moved in a negative direction and the amount of fuel delivered to the cylinders per stroke is decreased. In graph 56 it can be seen that at 1400 rpm and below the torque developed by the engine is dramatically decreased. In addition, the production of smoke is likewise limited at engine speeds below 1400 rpm.

Referring to FIG. 2, the effect of the pressure regulator 7 is indicated by the upward sloping linear curve 65. The slope of this curve is fixed by the number, mass, and geometry of the flyweights and the area of the top of the spool valve 21*a*. The position of this curve crosses 65 along the horizontal axis is controlled by the spring 40. That is to say, the spring controls the speed at which Point C occurs which is the point at which the regulated fuel rack curve 65 crosses the fixed rack lug curve. For example, if the compression on the spring is increased, starred curves 56', 57' and 65' are produced. Thus, it can be seen that by adjusting the compression of the spring, the maximum elevation in torque and the net production of smoke can be controlled by the apparatus described herein.

In summary, the present invention controls the generation of smoke and limits the rise in engine torque by pulling the fuel rack back when the engine lugs. Stability of the system and reliable performance are obtained by utilizing the spool valve 21*a*, the actuator member (19) and the spring 40.

Other aspects, objects, and advantages of this invention can be obtained from a study of the drawings, the disclosure and the appended claims.

I claim:

1. A rotation sensitive pressure regulator (7) having an inlet (26), an outlet (29), valve means (21) for regulating fluid pressure from the inlet (29), the valve means (21) including a reciprocal spool valve (21*a*), fly-weight means (13) for moving the spool valve (21*a*) in a first direction in response to rotation thereof to communicate the inlet (26) with the outlet (29), means (32) for urging the spool valve (21*a*) in a second direction opposite to the first direction in response to fluid pressure in the outlet (29), including pressure chamber means (34) for exposing fluid pressure to an end of the spool valve (21*a*), passage means (38) for communicating fluid pressure from the outlet (29) to the pressure chamber means (34), and compression spring means (40) for biasing the spool valve (21*a* ) in the second direction, means (39) for selectively adjusting the compression of the spring means (40) for establishing a balanced condition in the regulator (7) wherein the force applied to the spool valve (21*a*) by the fly-weight means (13) at least approximately equals and opposes the combined forces of the spring means (40) and the predetermined pressure in the pressure chamber means (34), means (24) for modulating the fluid pressure in the outlet (29) in response to the position of the spool valve (21*a*), and vent means (28) for venting fluid pressure in the outlet (29) in response to preselected movement of the spool valve (21*a*), in the second direction.

2. A rotation sensitive pressure regulator (7) having an inlet (26), an outlet (29), valve means (21) for regulating fluid pressure from the inlet (26) to the outlet (29), the valve means (21) including a reciprocal spool valve (21*a*), fly-weight means (13) for moving the spool valve (21*a*) in a first direction in response to rotation thereof to communicate the inlet (26) with the outlet (29), means (32) for urging the spool valve (21*a*) in a second direction opposite to the first direction in response to fluid pressure in the outlet (29), means (24) for modulating the fluid pressure in the outlet (29) in response to the position of the spool valve (21*a*), and a vent conduit (28), the means (24) for modulating the fluid pressure including a control land (24) on the spool valve (21*a*) sequentially movable between a first position communicating fluid pressure from the inlet (26) to the outlet (29), a second position blocking the outlet (29) from the inlet (26), and a third position communicating the outlet (29) with the vent conduit (28).

3. An apparatus for preventing excessive torque and/or excessive smoke in a combustion engine, comprising:

a pressure regulator (7) including an inlet (26) coupled to an intake manifold of the engine, an outlet (29), valve means (21) for regulating pressure from the inlet (26) to the outlet (29), the valve means (21) including a reciprocal valve spool (21*a*), a fly-weight assembly (13) operatively coupled to the engine and rotatable at a speed which is proportional to the speed of the engine, the flyweight assembly (13) being connected to the spool valve (21*a*) for moving the spool valve (21*a*) in a first direction in response to rotation of the fly-weight assembly (13) to provide a predetermined output pressure at the outlet (29), and means (32) for urging the spool valve (21*a*) in a second direction opposite the first direction in response to the predetermined output pressure at the outlet (29);

a fuel/air ratio controller (31) connected to the pressure regulator (7) and actuated by the predetermined pressure at the outlet (29); and a fuel rack (51) connected to and actuated by the fuel/air ratio controller (31).

4. The apparatus of claim 3 wherein the urging means (32) includes:

a pressure chamber (34) in the regulator (7) adjacent the end of the spool valve (21*a*); a passage (38) connecting the pressure chamber (34) to the outlet (29); and a compression spring (40) in operative engagement with the spool valve (21*a*).

5. The apparatus of claim 4 further including means (39) for selectively adjusting the compression of the spring (40) to establish a balanced condition in the regulator (7) wherein the force applied to the spool valve (21*a*) by the fly-weight assembly (13) at least approximately equals the combined and opposing forces of the compression spring (40) and the predetermined pressure in the pressure chamber (34).

6. The apparatus of claim 3 wherein the spool valve (21*a*) is actuated by the fly-weight assembly (13) via a nondeformable stem (19) on the spool valve (21*a*).

7. A rotation sensitive pressure regulator (7) comprising:

an inlet (26), an outlet (29), a vent conduit (28), a spool valve (21*a*), sequentially movable between a first position communicating fluid pressure from said inlet (26) to said outlet (29), a second position blocking said outlet (29) from said inlet, and a third position communicating said outlet (29) with said vent conduit (28), flyweight means (13) for moving said spool valve (21*a*) in a first direction and towards its first position in response to rotation of said flyweight means (13), and means (32) for urging said spool valve (21*a*) in a second direction opposite to said first direction and towards its third position in response to fluid pressure in said outlet (29).

* * * * *